US006039309A

United States Patent [19]

Kuklinski

[11] Patent Number: 6,039,309

[45] Date of Patent: Mar. 21, 2000

[54] METHOD AND APPARATUS FOR PRODUCING GAS BUBBLES IN A LIQUID MEDIUM

[75] Inventor: Robert Kuklinski, Portsmouth, R.I.

[73] Assignee: The United States of America as represented by the Secretary of the Navy, Washington, D.C.

[21] Appl. No.: 08/986,024

[22] Filed: Dec. 5, 1997

[51] Int. Cl.[7] ..... B01F 3/04

[52] U.S. Cl. ..... 261/1; 261/81; 261/DIG. 48

[58] Field of Search ..... 261/1, 81, DIG. 48; 210/748

[56] References Cited

U.S. PATENT DOCUMENTS

| | | | |
|---|---|---|---|
| 3,373,752 | 3/1968 | Inoue | 261/1 |
| 4,085,170 | 4/1978 | Simpson et al. | 261/DIG. 48 |
| 4,141,939 | 2/1979 | Oshima | 261/DIG. 48 |
| 4,793,714 | 12/1988 | Gruber | 261/81 |
| 5,585,044 | 12/1996 | Kawakami et al. | 261/1 |
| 5,688,405 | 11/1997 | Dickinson et al. | 210/748 |
| 5,688,406 | 11/1997 | Dickinson et al. | 210/748 |

*Primary Examiner*—C. Scott Bushey
*Attorney, Agent, or Firm*—Michael J. McGowan; James M. Kasischke; Prithvi C. Lall

[57] ABSTRACT

Disclosed is a method and apparatus for producing gas bubbles of a uniform size in a liquid. First, the liquid medium flows over a wall or other liquid containment surface. Gas is then emitted into the liquid medium to form gas bubbles from an aperture in the wall at a bubble formation position. A standing wave is then established in the liquid medium at the aperture. It is found that the bubbles formed at the aperture are of a substantially uniform size.

20 Claims, 3 Drawing Sheets

METHOD AND APPARATUS FOR PRODUCING GAS BUBBLES IN A LIQUID MEDIUM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to methods and apparatus for gas and liquid contact and more particularly to methods and apparatus for injecting a gas into a liquid medium.

(2) Brief Description of the Prior Art

The prior art method for producing bubbles in a liquid is essentially shown in FIG. 1. In this figure there is a liquid containment surface that is a wall 10, and on one side of this wall 10 there is liquid 12 which has a velocity profile 14. The apparatus also includes a gas source 16 that is connected by gas line 18 to gas flow regulator 20 that is connected by line 22 to plenum 24. There is an aperture 26 in wall 10 through which a gas bubble 28 is formed. It will be observed that this bubble grows in size and bubbles are continuously formed as, for example, bubble 30 and bubble 32.

Basically, the gas under pressure is forced through the aperture in the wall. As the gas enters the liquid, it grows until the local shear force is large enough to rip it from the wall as shown. In the case of a strong shear flow, bubbles on the order of the pore size may be produced. Changes in the gas flow rate predominately impact the rate at which bubbles are formed and not their size. To control the size of bubbles produced from such a device, the fluid flow must be controlled at the aperture. The control of the fluid flow is either impossible or impractical to any real degree for many applications.

SUMMARY OF THE INVENTION

A first purpose of the present invention is to provide a method and apparatus to produce uniform sized bubbles. A second purpose is to provide a device that produces such bubbles in the presence of a shear flow. A third purpose is to provide a device that produces a large volume of such uniform sized bubbles. A fourth purpose is to provide a device that is capable of producing a large bubble relative to a given pore size. A fifth purpose is to provide a device that is capable of producing a small bubble relative to a given pore size. A sixth purpose is to provide a device that produces uniform bubbles independent of fluid state. A seventh purpose is to provide a device that produces a predetermined spectrum of bubble sizes. An eighth purpose is to provide a device that functions with any type of gas ejected into any liquid.

The method and apparatus of this invention provides a means of using ultrasonic waves to act very near the surface of the wall that is ejecting gas into a boundary layer. This force is larger than the shear force very near the wall. The control of this force provides a means to act on individual bubbles as they leave an ejection port and allows individual bubbles to be produced of a uniform size.

Essentially, the method of the present invention produces gas bubbles in a liquid medium. First, the liquid medium flows over a wall or other liquid containment surface. Gas is then emitted into the liquid medium to form gas bubbles from an aperture in the wall at a bubble formation position. A standing wave is then established in the liquid medium at the aperture. It is found that the bubbles formed at the aperture are of a substantially uniform size. In one preferred embodiment, the standing wave is established using a wave generation means continuously forming waves moving in a wave direction in a generally perpendicular relation to the liquid containment surface and reflecting said waves from the liquid containment surface. In another preferred embodiment, the aperture is adjacent the liquid containment surface and a first wave generation means is positioned in spaced relation to the aperture while a second wave generation means is positioned in spaced relation to the aperture on the opposed side of the aperture.

The invention also includes an apparatus for producing gas bubbles comprising a liquid containment surface having at least one bubble formation aperture and a barrier projecting from said surface in generally normal relation to said surface to shield said bubble formation aperture. A wave generating means is positioned in a spaced relation to the liquid containment surface in opposed relation to said bubble formation means. When a liquid medium is caused to flow between the liquid containment surface and the wave generating means and a gas is emitted through the bubble formation aperture, the wave generation means is activated to continuously form waves which are reflected from the liquid containment surface to form a standing wave adjacent the gas emitting aperture. Gas bubbles of a substantially uniform size are then produced at the bubble formation aperture.

In an alternate preferred embodiment, the apparatus for producing gas bubbles comprises a liquid containment surface having at least one bubble formation aperture and two wave generation means. A first wave generating means is positioned adjacent the liquid containment surface in spaced relation to the bubble formation aperture. This wave generating means directs waves obliquely away from the liquid containment surface. A second wave generating means is positioned adjacent the liquid containment surface in spaced relation to the bubble formation aperture. This wave generating means is positioned to direct waves obliquely away from the liquid containment surface in relation with the waves generated by the first wave generating means. When a liquid medium is caused to flow over the liquid containment surface and the wave generating means and a gas is emitted through the bubble formation aperture. The first and second generating means form a standing wave adjacent the gas emitting aperture. Gas bubbles of a substantially uniform size are thus produced at the bubble formation aperture.

The waves produced will ordinarily be acoustical waves having a frequency of from 0.2 MHz to 20 MHz. It is found that under such conditions, bubbles of a diameter of from 18.75 $\mu$m to 1875 $\mu$m are produced in water.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DETAILED DESCRIPTION OF THE PREFERRED EMBODIMENT

Figure 1:
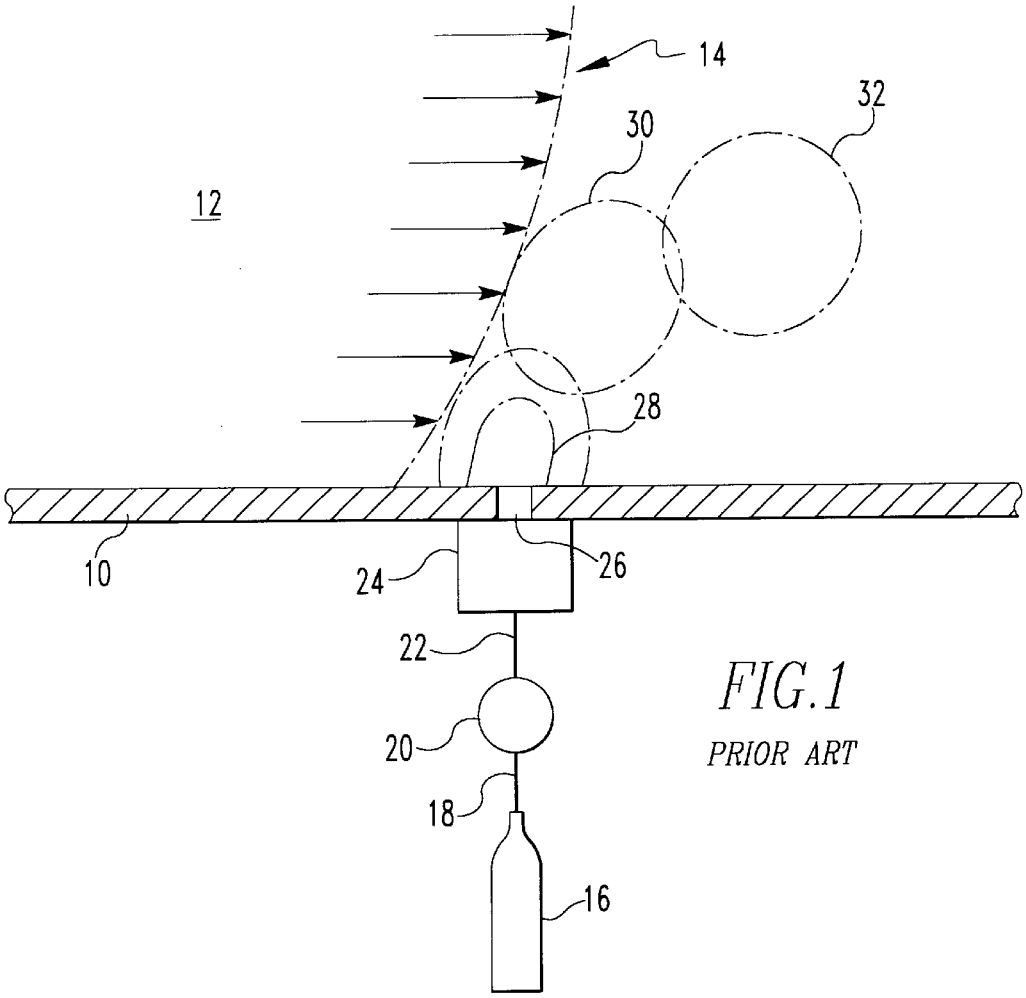
FIG.1 PRIOR ART
FIG. 1 is a schematic vertical cross sectional view of a prior art apparatus for producing gas bubbles in a liquid medium.
Figure 2:
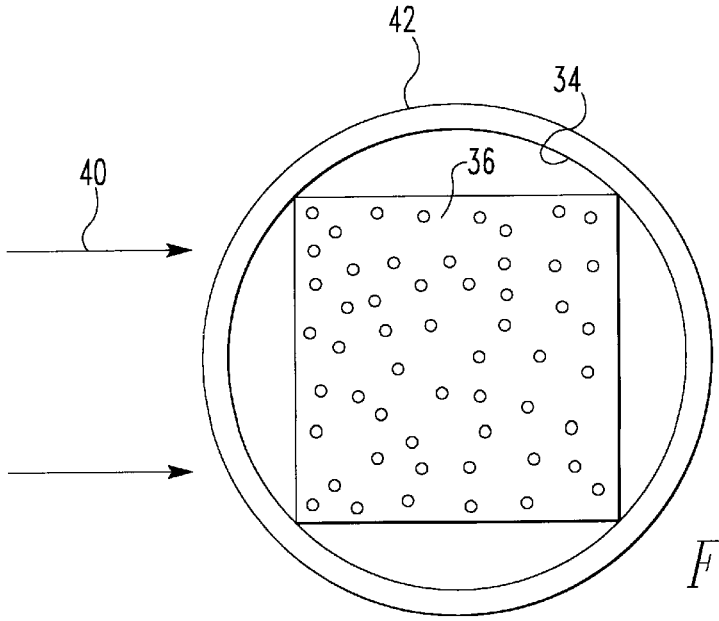
FIG. 2 is a top plan view of a portion of the apparatus of the present invention for producing gas bubbles in a liquid medium.
Figure 3:
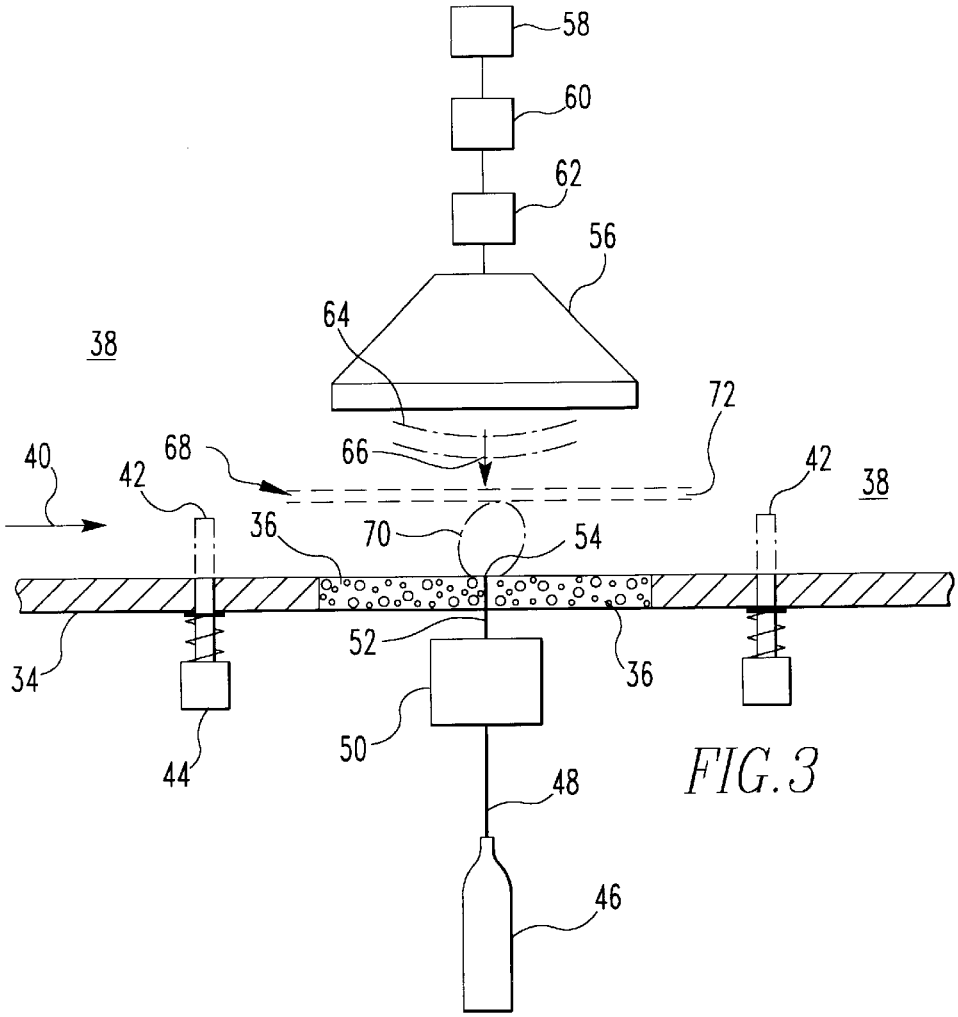
FIG. 3 is a schematic vertical cross sectional view of the apparatus shown in FIG. 2.

Referring to FIGS. 2 and 3, a closed system embodiment of the apparatus of the present invention is shown in which there is a wall 34 which includes an area of acoustically reflective material 36. On one side of wall 34 there is a liquid medium 38 which flows as in the flow direction 40 which is parallel to wall 34. Surrounding the acoustically reflective material 36 on wall 34, there is a flow barrier 42, which can be raised or lowered by means of an actuator 44 on the opposed side of wall 34. Also, on the opposed side of wall 34 there is a gas source 46 which is connected by gas line 48 to gas flow regulator 50 which is connected by line 52 to a gas emitting aperture 54. Line 52 or gas flow regulator 50 can be connected to multiple apertures 54. Gas from gas source 46 is released through the wall in gas emitting aperture 54 into the liquid medium 38. On the opposed side of the wall there is a transducer 56 which includes a controller 58, a signal generator 60 and an amplifier 62. It will be noted that the barrier 42 and apertures 54 are normal to wall 34.

Referring particularly to FIG. 3, liquid medium is caused to flow between the wall 34 and the transducer 56. The transducer 56 is activated to produce acoustic waves 64 that travel in direction 66 toward the wall 34. Preferably, the direction 66 of the waves will be perpendicular to wall 34. These waves 64 are reflected from the acoustically reflective material 36 to produce a standing wave 68 between the transducer 56 and the wall 34. At the same time, gas from gas source 46 is released from the gas emitting aperture 54 to produce gas bubbles 70. It is found that gas bubbles 70 released into such a standing wave 68 will have a desirably uniform diameter which is further found inversely proportional to the frequency of the waves generated by the transducer 56 and the nodes 72 of the standing wave.

Figure 4:
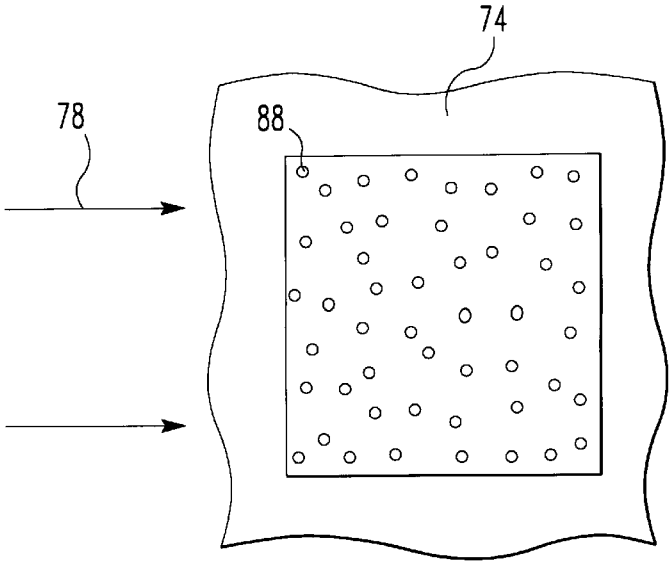
FIG. 4 is a top plan view of a portion of the apparatus of the present invention for producing gas bubbles of uniform size in a liquid medium.
Figure 5:
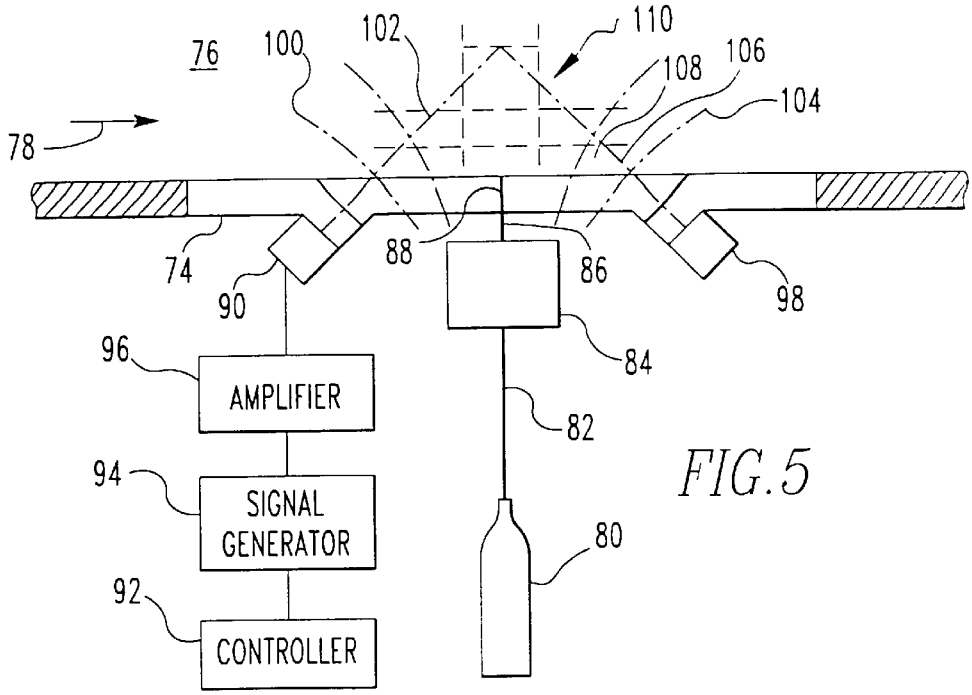
FIG. 5 is a schematic vertical cross sectional view of the apparatus shown in FIG. 4.

Referring to FIGS. 4 and 5, another preferred embodiment of the apparatus of the present invention is illustrated having an acoustically transparent wall 74. On the upper side of the wall there is a liquid medium 76 which has a flow direction 78. To the opposed side of the wall there is a gas source 80 which is connected by a line 82 to a gas flow regulator 84. The gas is further conveyed in line 86 to a gas emitting aperture 88. Upstream from the gas emitting aperture 88 there is a transducer 90 that includes an associated controller 92, a signal generator 94 and an amplifier 96. To the opposed downstream side of the gas emitting aperture 88 there is a second transducer 98 which is essentially identical to transducer 90 and includes an associated controller, signal generator and amplifier (not shown). The first transducer 90 produces moving acoustic waves 100 in an oblique direction 102 to the wall 74. The second transducer 98 produces moving acoustic waves 104 in a second wave direction 106 which is oblique to the wall 74 and which intersects with the first wave direction 102. Preferably, the first wave direction 102 and the second wave direction 106 will be disposed at an angle 108 which is 45 degrees from the wall 74. The intersection of the waves produced by the first transducer 80 and the second transducer 88 will produce a standing wave field 110. The transducers 90 and 98 may be positioned such that the standing wave is at or within surface 74.

Figure 6A:
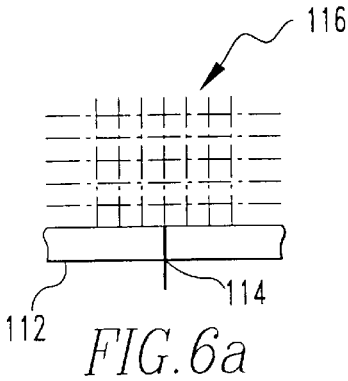
FIG. 6*a* is a schematic vertical cross sectional view of a standing wave field produced in an open system, high frequency embodiment of the method of the present invention.
Figure 6B:
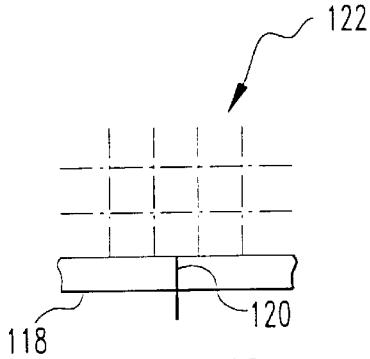
FIG. 6*b* is a schematic vertical cross sectional view of a standing wave field produced in an open system, low frequency embodiment of the method of the present invention.
Figure 6C:
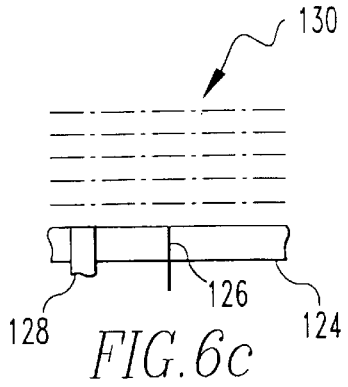
FIG. 6*c* is a schematic vertical cross sectional view of a standing wave produced in a closed system, high frequency embodiment of the method of the present invention.
Figure 6D:
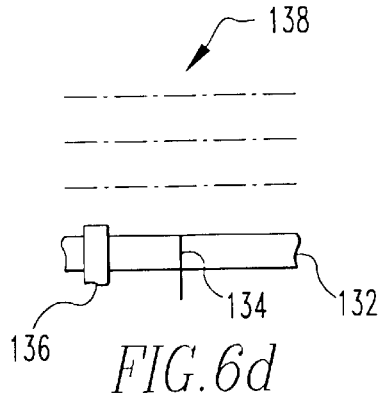
FIG. 6*d* is a schematic vertical cross sectional view of a standing wave produced in a closed system, low frequency embodiment of the method of the present invention.

FIG. 6*a* shows an open system as in FIG. 5 utilizing a higher acoustic frequency. In this arrangement an acoustically transparent wall 112, a gas emitting aperture 114 and a standing wave field 116 with closely spaced nodes is shown. In FIG. 6*b* a similar arrangement is shown in which a low frequency standing wave field is produced by the transducers. There is an acoustically transparent wall 118 and in which there is a gas emitting aperture 120 and a standing wave field 122 in which the nodes of the standing waves are positioned at greater intervals than is shown in the high frequency embodiment of FIG. 6*a*. In FIG. 6*c* a high frequency closed system is shown in which there is an acoustically reflective wall 124 with a gas transmitting aperture 126 and a lowered flow barrier 128. In this embodiment there is a standing wave 130 having closely spaced nodes. In FIG. 6*d* there is shown a low frequency closed system in which wall 132 has a gas emitting aperture 134. There is a raised flow barrier 136 in this low frequency closed arrangement and a standing wave pattern 138 having waves spaced at greater distance than the high frequency pattern shown in FIG. 6*c*. The raised flow barrier 136 is needed for larger bubble sizes in order to retard flow. Flow must be reduced to allow larger bubbles to develop before breaking away from wall 132.

A flow barrier may also be used in the open system shown in FIG. 6*b*. In the open configuration, the flow barrier causes drag which is undesirable in a primary application of this device; however, other applications which require large bubbles in an open device configuration can utilize a flow barrier.

It will be appreciated that a method and apparatus has been described for inexpensively and efficiently producing gas bubbles in a liquid medium which are substantially uniform in size and which can be produced in large numbers. It will also be appreciated that the size of these bubbles may be efficiently controlled by selecting an appropriate acoustical frequency.

It will also be appreciated that other advantages are that uniform bubbles can be produced in the presence of shear flows. Also, by means of the method of the present invention, small bubbles can be produced from relatively large pores and large bubbles can be produced from relatively small pores. Further, a predetermined spectrum of bubble sizes can be produced, and uniformly sized bubbles can be produced in any liquid/gas combination.

It will also be appreciated that the method and apparatus of the present invention has numerous advantages over prior art devices including increased uniformity of bubbles produced, increased volumes of like-sized bubbles, the ability to operate with a wider variety of working fluids and the ability to act on bubbles very near the wall.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An apparatus for generating uniformly sized gas bubbles in a flowing liquid, said apparatus comprising:

a liquid boundary surface positioned in said flowing liquid such that said flowing liquid flows externally of said surface, said surface having at least one bubble formation aperture therein;

a gas source in communication with said liquid boundary surface having said at least one bubble formation aperture; and at least one acoustic standing wave generating means positioned to generate standing waves in said liquid at said liquid boundary surface having said at least one bubble formation aperture whereby uniformly sized gas bubbles are generated at said bubble formation aperture.

2. An apparatus as in claim 1 wherein said acoustic standing wave generating means comprises:

at least one acoustic wave generating means is positioned in directly opposed relation to said liquid boundary surface; and said liquid boundary surface is acoustically reflective, and said standing waves are created by said generated waves and said reflected waves between said at least one acoustic wave generating means and said liquid boundary surface.

3. An apparatus for generating uniformly sized gas bubbles in a flowing liquid, said apparatus comprising:

a liquid boundary surface being acoustically reflective and having at least one bubble formation aperture therein;

a gas source in communication with said liquid boundary surface having said at least one bubble formation aperture;

at least one acoustic wave generating means positioned in directly opposed relation to said liquid boundary surface to generate standing waves in said liquid at said liquid boundary surface having said at least one bubble formation aperture, and said standing waves being created by said generated waves and said reflected waves between said at least one wave generating means and said liquid boundary surface; and a barrier means positioned in said liquid boundary surface for shielding said bubble formation aperture from said flowing liquid.

4. The apparatus of claim 3 wherein said barrier means is cylindrical and positioned about said at least one bubble formation aperture.

5. The apparatus of claim 3 wherein said barrier means is retractable.

6. The apparatus of claim 3 further comprising a regulator in communication between said gas source and said at least one bubble formation aperture.

7. The apparatus of claim 6 further wherein said at least one bubble formation aperture comprises a plurality of bubble formation apertures in said liquid boundary surface.

8. The apparatus of claim 1 further comprising a regulator in communication between said gas source and said at least one bubble formation aperture.

9. The apparatus of claim 8 further wherein said at least one bubble formation aperture comprises a plurality of bubble formation apertures in said liquid boundary surface.

10. The apparatus of claim 1 wherein said at least one acoustic standing wave generating means comprises two acoustic wave generating means positioned within said liquid boundary surface and directed to generate acoustic waves, said generated waves from one acoustic generating means intersecting with one other acoustic wave generating means and thereby creating a standing wave in said liquid above said bubble formation aperture.

11. The apparatus of claim 10 further comprising a regulator in communication between said gas source and said at least one bubble formation aperture.

12. The apparatus of claim 11 further wherein said at least one bubble formation aperture comprises a plurality of bubble formation apertures in said liquid boundary surface.

13. The apparatus of claim 10 further comprising a barrier means positioned in said liquid boundary surface for shielding said bubble formation aperture from said flowing liquid.

14. The apparatus of claim 13 wherein said barrier means is retractable.

15. A method of producing gas bubbles in a liquid medium comprising the steps of:

providing a liquid boundary surface in said liquid medium;

causing the liquid medium to flow in a flow direction externally over said liquid boundary surface;

emitting gas into the liquid medium to form gas bubbles at a bubble formation position; and establishing a standing wave in said liquid medium at said bubble formation position whereby the gas bubbles formed at said bubble formation position are of a substantially uniform size whereby uniformly sized gas bubbles are generated at said bubble formation position.

16. The method of claim 15 wherein the standing wave is established by the steps of:

continuously forming waves at a wave generation means, said formed waves moving in a wave direction in generally perpendicular relation to the liquid boundary surface; and reflecting said waves from the liquid boundary surface.

17. The method of claim 16 wherein the bubble formation position is adjacent the liquid boundary surface, and the wave generation means is positioned in spaced, opposed relation to the liquid boundary surface.

18. The method of claim 16 further comprising the step of providing a barrier means projecting from the liquid boundary surface.

19. The method of claim 18 wherein the barrier means projects from the liquid boundary surface in a direction normal thereto.

20. The method of claim 15 wherein the standing wave is established by continuously forming waves at a first wave generation means, said waves moving in a first wave direction, and continuously forming waves at a second wave generation means, said waves moving in a second wave direction, such that said second wave direction intersects said first wave direction.

* * * * *